United States Patent [19]

Sakamaki et al.

[11] Patent Number: 4,479,763

[45] Date of Patent: Oct. 30, 1984

[54] ROTARY COMPRESSOR

[75] Inventors: Hiroshi Sakamaki, Tochigi; Yukio Horikoshi, Saitama, both of Japan

[73] Assignee: Nippon Piston Ring Co., Ltd., Tokyo, Japan

[21] Appl. No.: 433,368

[22] Filed: Oct. 7, 1982

[30] Foreign Application Priority Data

Oct. 13, 1981 [JP] Japan ..... 56-162025

[51] Int. Cl.[3] ..... F04C 18/00

[52] U.S. Cl. ..... 418/144; 418/173; 418/269

[58] Field of Search ..... 418/268, 269, 173, 144; 384/100, 114, 398, 399; 308/DIG. 1

[56] References Cited

U.S. PATENT DOCUMENTS

| | | | |
|---|---|---|---|
| 889,875 | 6/1908 | Gerrich | 418/144 |
| 2,324,903 | 7/1943 | Beckman | 418/173 |
| 4,120,623 | 10/1978 | Löhn | 418/173 |
| 4,174,136 | 11/1979 | Hällstedt | 384/100 |
| 4,177,024 | 12/1979 | Löhn | 418/173 |
| 4,225,308 | 9/1980 | Löhn | 418/173 |

FOREIGN PATENT DOCUMENTS

| | | | |
|---|---|---|---|
| 1072003 | 6/1967 | United Kingdom | 308/DIG. 1 |

*Primary Examiner*—Michael Koczo
*Assistant Examiner*—John J. McGlew, Jr.
*Attorney, Agent, or Firm*—Birch, Stewart, Kolasch & Birch

[57] ABSTRACT

A sliding-vane type oil free rotary compressor comprising a rotary sleeve rotatably mounted in a center housing, a rotor eccentrically contained in the rotary sleeve, and a plurality of vanes movably fitted in the rotor. The rotary sleeve and the center housing are arranged to define an annular pressure chamber between their inner and outer surfaces. A part of the compressed fluid is introduced to at least a high-pressure passage and then injected therefrom to the pressure chamber through a throttle to produce dynamic pressure for floatingly supporting the rotary sleeve.

10 Claims, 5 Drawing Figures

ROTARY COMPRESSOR

BACKGROUND AND SUMMARY OF THE INVENTION

The present invention relates to a sliding-vane type oil free rotary compressor for compressing gas and gas-liquid mixtures, and more particularly to such a compressor that is utilizable as a supercharger for a vehicle internal-combustion engine, an air pump, and a frigerant compressor, which are required to run at a wide range of rotary speeds and at a large flow rate.

In general, compressors have differing problems depending upon their applications. In the case of compressors for the compression of compressible fluid, the most important problem is a temperature rise which results from both adiabatic compression and from sliding friction. For example, the high compression ratio and large flow rate compressor has its temperature elevated up to about 250° C., exceeding the tolerable temperature of the compressor's parts such as the vane, cylinder, bearing, and seal member. Oil lubricated type compressors have their frictional parts lubricated as well as cooled by oil. But, they cannot be used as superchargers for an internal-combustion engine because of the necessary requirement of requiring a device for recovering oil from the discharge fluid.

Oil free type rotary compressors, having neither lubricating oil nor cooling effect by oil, should minimize heat generated from sliding friction irrespective of unavoidable heat developed from adiabatic compression. The sliding friction between the apex of the vane and the inner surface of the cylinder produces heat more than any other frictional parts. In order to reduce the sliding friction, Japanese Published Unexamined Patent Applications (Kokai Tokkyo Koho) Nos. 52-71713 and 56-18092 have disclosed a compressor comprising a rotary sleeve rotatably mounted in the cylinder and floatingly supported by oil. The rotary sleeve rotates together with the rotor to prevent the apex of each vane from sliding on the inner surface of the rotary sleeve. However, the compressor as disclosed above is unsuitable as a compressor required to run at a wide range of rotary speeds and have a relatively high compression ratio and a large capacity. The reason for this is that, although oil or incompressible fluid is effective to support the rotary sleeve in stationary running in which the fluid lubricating conditions are maintained, it inevitably accompanies a seizure due to lack of oil under the boundary lubricating conditions in the initial period of running, an oil leakage due to a high pressure produced in high speed running, and damage due to an abnormally high localized pressure.

The present invention is intended to solve the problem of how to design a compressor that can be used at a high compression ratio and a wide range of rotary speeds. According to the invention, the sliding-vane type oil free rotary compressor comprises a center housing, a rotary sleeve mounted in the center housing with the intervention of a pressure chamber, at least one high-pressure passage extending from a discharge chamber and opening to the pressure chamber through the intermediary of a throttle, and an exhaust port extending from the pressure chamber to a suction chamber or the atmosphere, whereby the rotary sleeve is floatingly supported by the dynamic pressure of a compressible fluid.

Accordingly, it is an object of the present invention to provide an improved compressor that is free from problems created by the use of oil or an incompressible fluid.

It is another object of the present invention to provide an improved compressor in which a rotary sleeve is floatingly supported by a compressible fluid.

Other objects of the present invention will appear in the following description and appended claims taken in connection with accompanying drawings.

DESCRIPTION OF THE PREFERRED EMBODIMENTS

Figure 1:
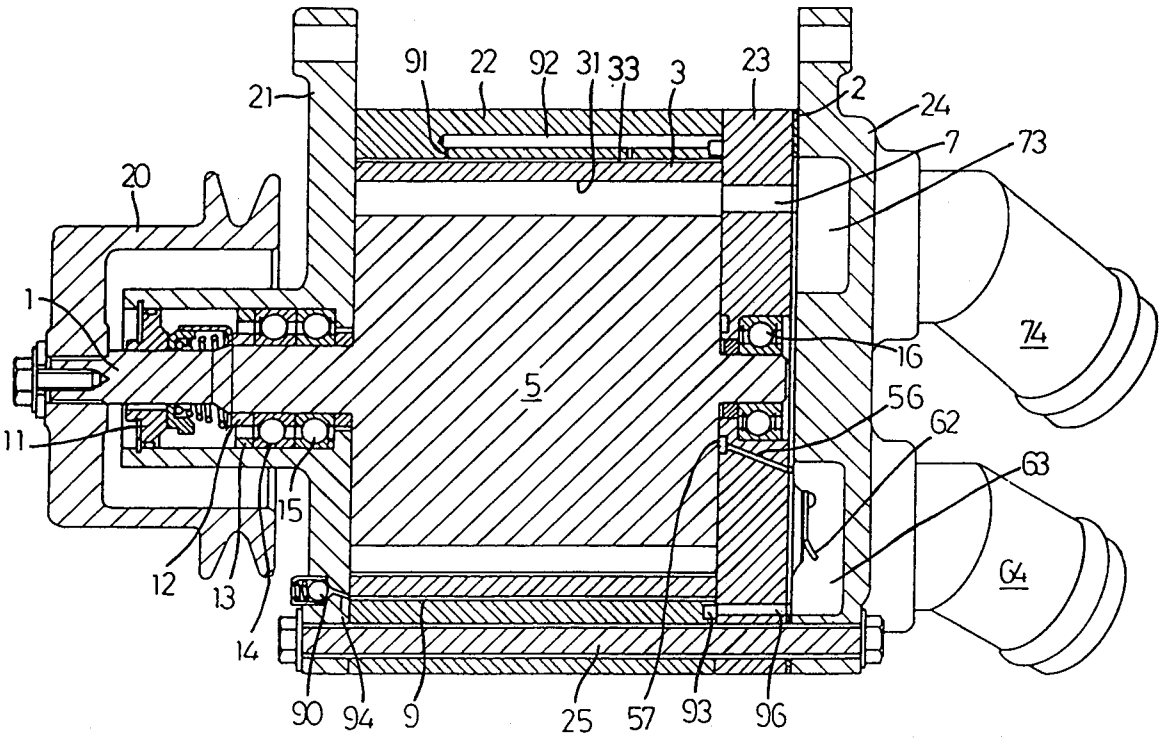
FIG. 1 is a longitudinal section of the compressor of the present invention.
Figure 2:
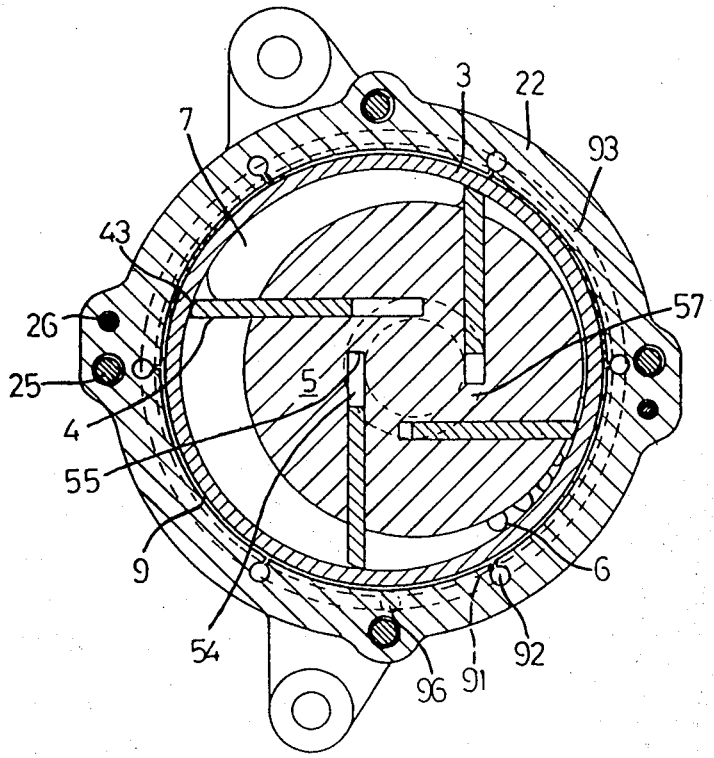
FIG. 2 is a cross-section of the compressor of FIG. 1.

As seen in FIGS. 1 and 2, the compressor has a rotary shaft 1 shaped integrally with a rotor 5 and a pulley 20 fixed to the front end of the shaft 1 which is driven by a non-illustrated crank shaft of an engine or the like. The rotary shaft 1 and the rotor 5 are supported by bearings 14, 15, 16 and air-tightly sealed by a mechanical seal 11 within the pulley 20. The bearings 14, 15, 16 are of a ball type to prohibit the rotor 5 from deflecting and enable it to rotate at very high speeds. The bearings 14, 15 have their outer and inner rings placed at close intervals and the respective inner and outer rings axially pressed on each other by inner or outer collars 12, 13. The axial preload causes the bearings 14, 15 to receive a thrust acting on the rotor 5 and prevent radial and axial deflections of the rotor 5 with the result that clearances between the rotor 5 and the front and rear side housings 21, 23 are maintained.

A plurality of vanes 4 are radially slidably fitted in the respective vane grooves 54 of the rotor 5. The discharge pressure is introduced into the vane grooves 54 through a back-pressure passage 56 extending from a discharge chamber 63 to the root 55 of the vane groove to facilitate protrusion of the vane 4. Air in the suction chamber 73, in place of air in the discharge chamber, may be extracted and introduced to the vane grooves 54. An annular groove 57 is provided in the inner side surface of the rear side housing 23 to distribute the back pressure from the back-pressure passage to the respective vane grooves 54. The annular groove 57 is preferably divided into more than two parts to apply an appropriate pressure to the respective vanes 4 in accordance with their positions. For example, the vane groove 57 may be blind when the vane 4 is at its top dead center.

The rotary sleeve 3 as well as the rotor 5 is contained in a center housing 22 and laterally covered by the front and rear side housings 21, 23. At least one of the side housings is formed with discharge and suction bores 6, 7. For example, axially lengthwise compressors of large flow rate have the discharge and suction bores in each of the side housings. The rear side housing 23 is secured through a gasket 2 to a rear cover 24, in which discharge and suction chambers 63, 73 are provided. The discharge chamber 63 is provided with a discharge valve 62, which opens and closes the discharge bores 6.

The rear cover 24 is provided with a couple of discharge and suction ports 64, 74, which lead to a non-illustrated supercharging line of an engine. The front, center and rear housings 21, 22, 23 and the rear cover 24 are positioned by pins 26 and fastened as one body by bolts 25.

The rotary sleeve 3 has the inner surface 31 contacted with the vanes 4 and the outer surface 33 loosely fitted in the center housing 22 with the intervention of a pressure chamber 9 defined between the outer surface of the rotary sleeve 3 and the inner surface of the center housing 22. The pressure chamber 9 is connected to high-pressure passages 92 through throttles 91. The plurality of high-pressure passages 92 are equidistantly disposed in the center housing 22 and connected to the discharge chamber 63 through an annular passage 93 in the center housing 22 and a piercing passage 96 in the rear housing 23, so that a part of compressed gas in the discharge chamber 63 injects into the pressure chamber 9 through the throttle 91. In general, the piercing, annular, and high-pressure passages 96, 93, 92 are cross-sectionally larger than the throttle 91 to have the same static pressure therein as the discharge chamber 63. But, if the pressure is very high in the discharge chamber, those passages may given a cross-section similar to the throttle to increase their resistances.

The throttle 91 acts as an orifice or nozzle to convert a static pressure of the high-pressure passage 92 similar to that of the discharge chamber 63 into a dynamic pressure which is applied to the pressure chamber 9 to support the rotary sleeve 3. The static and dynamic pressures in the pressure chamber 9 are significantly affected by the radial width or clearance between the center housing 22 and the rotary sleeve 3. There is obtained the following relation among clearance Cr(mm), discharge chamber pressure Ps(Kg/sq.mm), throttle radius r(mm) and flow coefficient Cf $$Cr^6 = Cf^2 r^4 / Ps \times Fa(\text{resultant factor})$$

in which $Fa = 3.244 \times 10^{-2}$ [Kg] in the case of air injected to support the rotary sleeve as shown in FIG. 1. The relation gives Cr a value in a range of 0.05 mm to 0.1 mm in the case of $2r = 1.5$ mm and $Ps = 0.04$(air; 4 Kg/sq.cm). This means that the pressure chamber 9 has a radial width substantially similar to a dimensional tolerance of 0.1 mm to 0.2 mm between the outer diameter of the rotary sleeve 3 and the inner diameter of the center housing 22.

The gas supplied to the pressure chamber 9 is generally vented through a check valve 90 from an exhaust port 94 to a discharge line. But, if the rotary sleeve is mostly supported by a dynamic pressure, the exhaust port 94 may be directly vented to the open air, as seen in FIG. 1. Upon the requirement of a static pressure in addition to the dynamic pressure, the check valve 90 is adjusted to produce such a condition. In the case of any other fluid than air, it is desirable to open the exhaust port 94 to the suction chamber 73 and prohibit the fluid from dispersing into the atmosphere. If a gas-liquid mixture is compressed, a non-illustrated separater is provided in the piercing passage 96.

The compressor of the present invention supports the rotary sleeve 3 by help of the dynamic pressure converted from the static pressure of the discharge chamber 63 through the throttle 91 and the static pressure in the pressure chamber 9, if needed. Compressible fluid supporting the rotary sleeve produces no abnormal high pressure unlike incompressible fluid whenever the rotary speed is very rapid and the discharge pressure is high. This is the reason why the inventive compressor is suitable for operation at a wide range of rotary speeds and free from leakage of fluid, damage and wear due to abnormally high pressure. In the initial period of operation in which compression ratio is too low to float the rotary sleeve, no trouble occurs from the rough rotation of the rotary sleeve or sliding friction between the rotary sleeve and the vane, because the compressor is still being slowly rotated by the engine.

The most important feature of the present invention is that a balance between a resistant force R1 of the rotary sleeve 3 against the center housing 22 and the other resistant force R2 of the rotary sleeve 3 against the vanes 4 depends upon the rotational speed of the rotor 5 so that the relative sliding movement is automatically maintained in an optimum condition. This results from the fact that a displacement type rotary compressor generally has its discharge pressure increasing not proportionally to but gradually with the number of rotations per minute when the rotational number exceeds a certain number, though R1 as well as R2 increases in proportion to the discharge pressure and the rotational number. The vane 4 slides on the rotary sleeve 3 to produce a friction due to R2 that is absolutely smaller than R1 in a range of relatively low rotary speeds, and the rotary sleeve 3 slides on the center housing 22 to produce the other friction due to R1 that is absolutely smaller than R2 in the other range of relatively high rotary speeds. Thus, the frictional resistance is always small in the full range of rotary speeds and, therefore, heat generated from the frictional resistance is minimized. The balance is easily regulated to conform to running conditions by adjustment of the number and rate of throttles 91, and the number of vanes 4.

Figure 3:
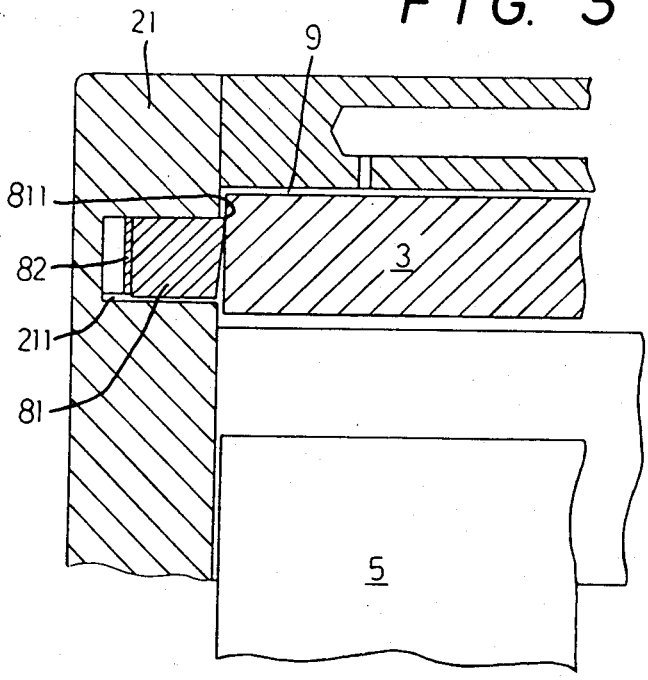
FIG. 3 is a partially enlarged section of another embodiment.

For the purpose of improving the function of the pressure chamber 9 in the compressor of the present invention, as seen in FIG. 3, it is desirable to provide both side seal rings 81 in either of the rotary sleeve and both side housings. The front side housing 21 is formed at an annular position corresponding to the rotary sleeve 3 with a side seal ring groove 211 in which the side seal ring 81 is inserted and pressed to the rotary sleeve 3 by a resilient member 82 made of a spring or O-ring for maintaining air-tightness between the rotary sleeve 3 and the front side housing 21. The side seal ring 81 has its lip 811 leaned toward the pressure chamber 9 for use with compressors of usual compression ratio, but toward the rotor 5 for use with compressors of particularly high compression ratio. The other side seal ring is similarly disposed in the rear side housing. Both of the side seal rings may be mounted in the opposite sides of the rotary sleeve of which the thickness is sufficiently thick. The side seal ring 81 isolates the compression chamber from the pressure chamber 9. The resilient member 82 causes the side seal ring 81 to prevent the axial deviation of the rotary sleeve 3 and bring the stable rotation of the same.

Figure 4:
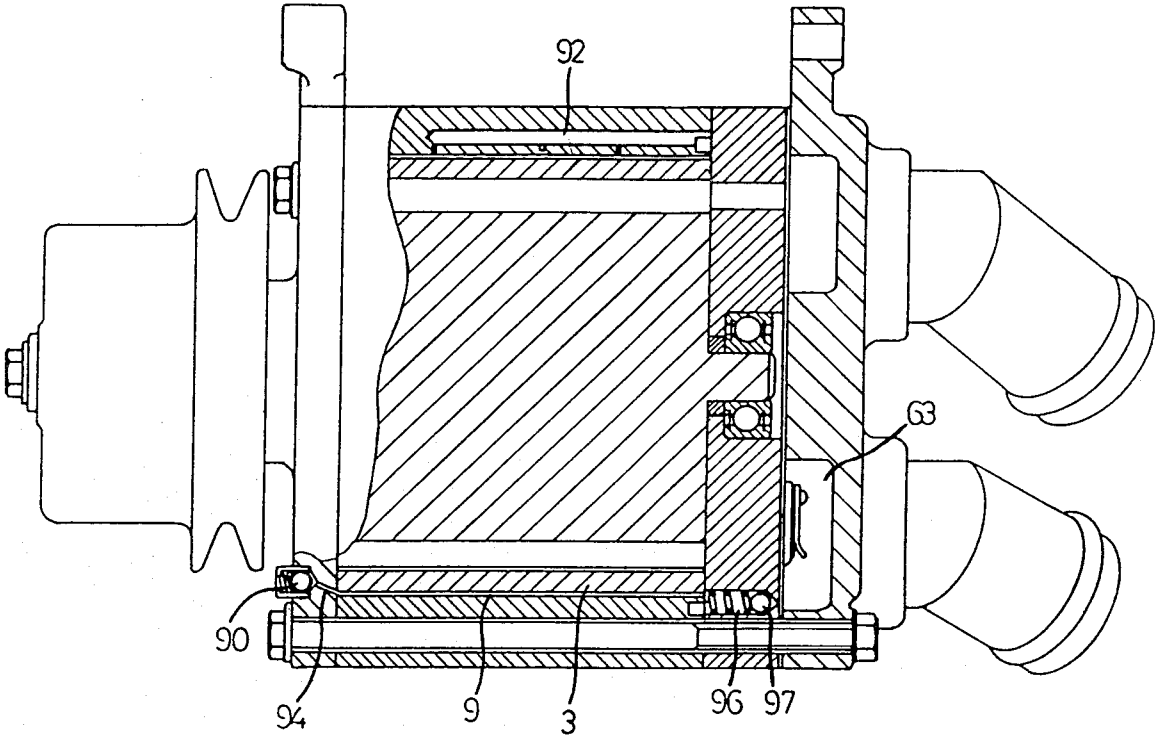
FIG. 4 is an elevation, partly in section, of a further embodiment.

As seen in FIG. 4, a check valve 97, opening to the high-pressure passage 92, is disposed in the piercing passage 96 between the discharge chamber 63 and the high-pressure passage 92 to prevent the static pressure in the pressure chamber 9 from being disturbed by a pressure fluctuation in the discharge chamber 63. The check valve 97 confines a certain amount of pressure gas within the pressure chamber 9 and the high-pressure passage 92 in cooperation with the check valve 90 in the exhaust port 94 when the compressor stops, so that the compressor can have its rotary sleeve 3 supported by the pressure gas immediately after it starts to run again.

Figure 5:
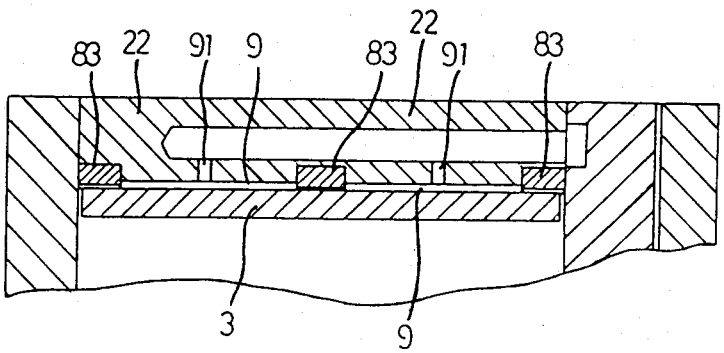
FIG. 5 is a partially somewhat enlarged section of a still further embodiment.

While the pressure in the pressure chamber 9 is insufficient to permit smooth rotation of the rotary sleeve 3 in the initial period of running, guide rings 83 prohibit the rotary sleeve 3 from shaking within the center housing 22 as seen in FIG. 5. Three annular guide rings 83 are disposed at the center and opposite ends of the center housing 22 to define the respective very small clearances on the outer surface of the rotary sleeve 3. The guide rings 83 only support the rotary sleeve 3 in the initial period of running in which neither static nor dynamic pressure exists in the pressure chamber 9 until the pressure chamber 9 is pressurized to float the rotary sleeve 3. Accordingly, the guide rings 83 never contact the rotary sleeve 3 in the normal running period in which the rotary sleeve 3 rotates at high speeds. In addition to both the inevitable guide rings at the opposite ends, one or more center guide rings are preferably provided to divide the pressure chamber 9 into two or more annular sections for the purpose of reducing the substantial volume of the pressure chamber 9 with respect to each throttle 91 and increasing the dynamic pressure converted by the throttle 91. Therefore, it is desirable for each annular section of the pressure chamber 9 to accomodate an individual throttle 91, as seen in FIG. 5. The guide ring 83 is formed with a non-illustrated slit or hole led to the exhaust port 94 of FIG. 4, in order to give a vent to the static pressure of the pressure chamber.

The oil free type compressor of the drawings has parts of wear-resistant materials. For example, the rotary sleeve 3, the most important sliding member, is made of light and less inertial ceramics such as silicon nitride. The vane 4 is manufactured from light and less inertial carbon or light alloy such as aluminium alloy which is superficially hardened to have wear-resistant and fatigue-resistant properties by anodic oxidation or the like. The guide ring 83, occasionally making direct contact with the rotary sleeve 3, is made of polytetrafluoroethylene or the same material as the vane 4. By preference, the housings are made of light and heat-conductive light alloys such as aluminium alloys. The center housing 22 is desirably hardened by anodic oxidation or made of ferrous materials.

From the foregoing, the compressor of the invention can support the rotary sleeve at a wide range of rotary speeds by the use of static and dynamic pressures of a compressible fluid, as compared with the conventional compressor using incompressible fluid to support the rotary sleeve. The compressor has a relatively small heat generated from sliding friction, because the rotary sleeve slides relative to either of the vane and the center housing so as to have a smaller resistant force. Therefore, it is particularly suitable for a supercharger required to operate at high compression ratios and large capacities for use in an automobile.

While the invention has been particularly shown and described with reference to preferred embodiments thereof, it will be understood by those skilled in the art that the foregoing and other changes in forms and details can be made therein without departing from the spirit and scope of the invention.

What is claimed is:

1. A rotary compressor comprising a center housing, two side housings, a rotary sleeve rotatably mounted in said center housing, a rotor eccentrically contained in said rotary sleeve, a plurality of vanes movably fitted in said rotor, a discharge chamber provided in said side housing, a pressure chamber defined by and between said rotary sleeve and said center housing and connected to said discharge chamber through at least a high-pressure passage, said high-pressure passage being disposed in the center housing and communicating with a passage extending to and along the side surface of said center housing, through said side housing and communicating with said discharge chamber, said high-pressure passage opening to said pressure chamber through at least one throttle means, whereby said rotary sleeve is floatingly supported by at least one of the static pressure of said pressure chamber and the dynamic pressure of fluid flowing through said throttle means from said high-pressure passage to said pressure chamber.

2. The rotary compressor as claimed in claim 1, wherein said rotary sleeve and said side housings have side seal rings disposed therebetween.

3. The rotary compressor as claimed in claim 2, wherein said side seal ring is pressed to said rotary sleeve by a resilient member.

4. The rotary compressor as claimed in claim 3, wherein said side seal ring has the lip thereof in contact with said rotary sleeve.

5. The rotary compressor as claimed in claim 1, wherein said center housing has at least two guide rings mounted on the inner surface thereof, said guide rings being disposed at the opposite ends of said center housing.

6. The rotary compressor as claimed in claim 5, wherein at least one of said guide rings is centrally disposed to divide said pressure chamber into a plurality of annular sections, each annular section being connected to said high-pressure passage through at least one of said throttle means.

7. The rotary compressor as claimed in claim 1, wherein said high-pressure passage is connected to said discharge chamber by a check valve adapted to open to said high-pressure passage.

8. The rotary compressor as claimed in claim 7, wherein the high-pressure passage has an annular passage formed in said center housing and a piercing passage formed in said side housing.

9. The rotary compressor as claimed in claim 1, wherein the pressure chamber is provided with an exhaust port.

10. The rotary compressor as claimed in claim 9, wherein the exhaust port is provided with a check valve.

* * * * *